US009488059B2

(12) United States Patent
Ventura et al.

(10) Patent No.: US 9,488,059 B2
(45) Date of Patent: Nov. 8, 2016

(54) FAN BLADE DOVETAIL WITH COMPLIANT LAYER

(75) Inventors: Peter Ventura, Enfield, CT (US); Carl Brian Klinetob, East Haddam, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 2180 days.

(21) Appl. No.: 12/535,997

(22) Filed: Aug. 5, 2009

(65) Prior Publication Data

US 2011/0033302 A1 Feb. 10, 2011

(51) Int. Cl.

| | |
|---|---|
| ***F01D 5/26*** | (2006.01) |
| ***F01D 5/28*** | (2006.01) |
| ***F01D 5/30*** | (2006.01) |

(52) U.S. Cl.

CPC ..... *F01D 5/282* (2013.01); *F01D 5/3092* (2013.01); *F05D 2300/432* (2013.01); *F05D 2300/501* (2013.01); *F05D 2300/603* (2013.01)

(58) Field of Classification Search

USPC ..... 416/219 R, 220 R, 221, 248

See application file for complete search history.

(56) References Cited

U.S. PATENT DOCUMENTS

| | | | | |
|---|---|---|---|---|
| 4,480,957 | A | 11/1984 | Patel et al. | |
| 5,310,317 | A | 5/1994 | Bailey et al. | |
| 5,340,280 | A | 8/1994 | Schilling | |
| 5,431,542 | A | 7/1995 | Weisse et al. | |
| 5,443,367 | A | 8/1995 | Samit et al. | |
| 5,573,377 | A * | 11/1996 | Bond et al. | 416/229 A |
| 5,993,162 | A | 11/1999 | Weisse et al. | |
| 6,244,822 | B1 | 6/2001 | Sinclair et al. | |
| 6,290,466 | B1 * | 9/2001 | Ravenhall et al. | 416/229 A |
| 7,121,803 | B2 | 10/2006 | Gautreau et al. | |
| 7,165,944 | B2 | 1/2007 | Gautreau et al. | |
| 7,451,639 | B2 | 11/2008 | Goldfine et al. | |
| 7,458,780 | B2 | 12/2008 | Weisse et al. | |
| 8,100,662 | B2 * | 1/2012 | Schreiber | 416/230 |
| 2007/0048142 | A1 * | 3/2007 | Dambrine et al. | 416/219 R |
| 2008/0187441 | A1 | 8/2008 | Schreiber | |
| 2009/0060745 | A1 | 3/2009 | Douguet et al. | |
| 2009/0090005 | A1 | 4/2009 | Carper et al. | |

OTHER PUBLICATIONS

Lancaster, J.K., Accelerated wear testing of PTFE composite bearing materials, Apr. 1979, IPC Business Press, Tribology International Apr. 1979, pp. 65-67.*

Miracle, Daniel and Donaldson, Steven, ASM Handbook vol. 21 Composites, Dec. 2001, ASM International, vol. 21 Composites, pp. 355-356.*

European Search Report for European Patent Application No. 10251401.5 completed on Jan. 16, 2014.

* cited by examiner

*Primary Examiner* — Eric Keasel
*Assistant Examiner* — Joshua R Beebe
(74) *Attorney, Agent, or Firm* — Carlson, Gaskey & Olds, P.C.

(57) ABSTRACT

A fan blade includes an airfoil and a dovetail at a radially inner end of the airfoil. The dovetail extends between first and second axial ends, and has outer circumferential faces. The dovetail is formed of relatively rigid composite material. Compliant material is placed on each outer circumferential face of the dovetail. The compliant material is less rigid than the composite material for forming the dovetail. In a second embodiment, the compliant layer may be positioned within the disk slots in a disk, such that the compliant layer will come in contact with circumferentially outer faces of the dovetail.

11 Claims, 3 Drawing Sheets

FAN BLADE DOVETAIL WITH COMPLIANT LAYER

BACKGROUND OF THE INVENTION

This application relates to a contact surface between a dovetail and a rotor slot for a turbine engine fan blade, wherein a compliant layer is disposed along the contact faces.

Gas turbine engines are known, and may include a fan section delivering air to a compressor section. The air is compressed and passed downstream into a combustion section. The air is intermixed with fuel in the combustion section and ignited. Products of this combustion pass downstream over turbine blades which are driven to rotate.

In one type of fan section, a rotor disk is provided with removable fan blades. Typically, the fan blades include an airfoil extending outwardly of the rotor disk and a dovetail which is positioned within a slot in the rotor disk.

During operation, the dovetail is forced into contact with the disk slot. Stresses are created at localized contact areas between the blades and disk slots. Often, the stresses are concentrated near the axial ends of the contact surfaces between the blades and the disk slots. This concentration is undesirable.

It is known to provide a crowned surface on the root of blades to minimize the fillet hoop tensile stresses. The crowned surface can flatten out under load and reduce stress. However, it is not believed that these root designs help reduce the high bearing contact stresses and resulting potential crushing of the axial ends of the roots.

SUMMARY OF THE INVENTION

A fan blade includes an airfoil and a dovetail at a radially inner end of the airfoil. The dovetail extends between first and second axial ends, and has outer circumferential faces. The dovetail is formed of relatively rigid composite material. Compliant material is placed on each outer circumferential face of the dovetail. The compliant material is less rigid than the composite material for forming the dovetail. In a second embodiment, the compliant layer may be positioned within the disk slots in a disk, such that the compliant layer will come in contact with circumferentially outer faces of the dovetail.

These and other features of the present invention can be best understood from the following specification and drawings, the following of which is a brief description.

DETAILED DESCRIPTION OF THE PREFERRED EMBODIMENT

Figure 1:
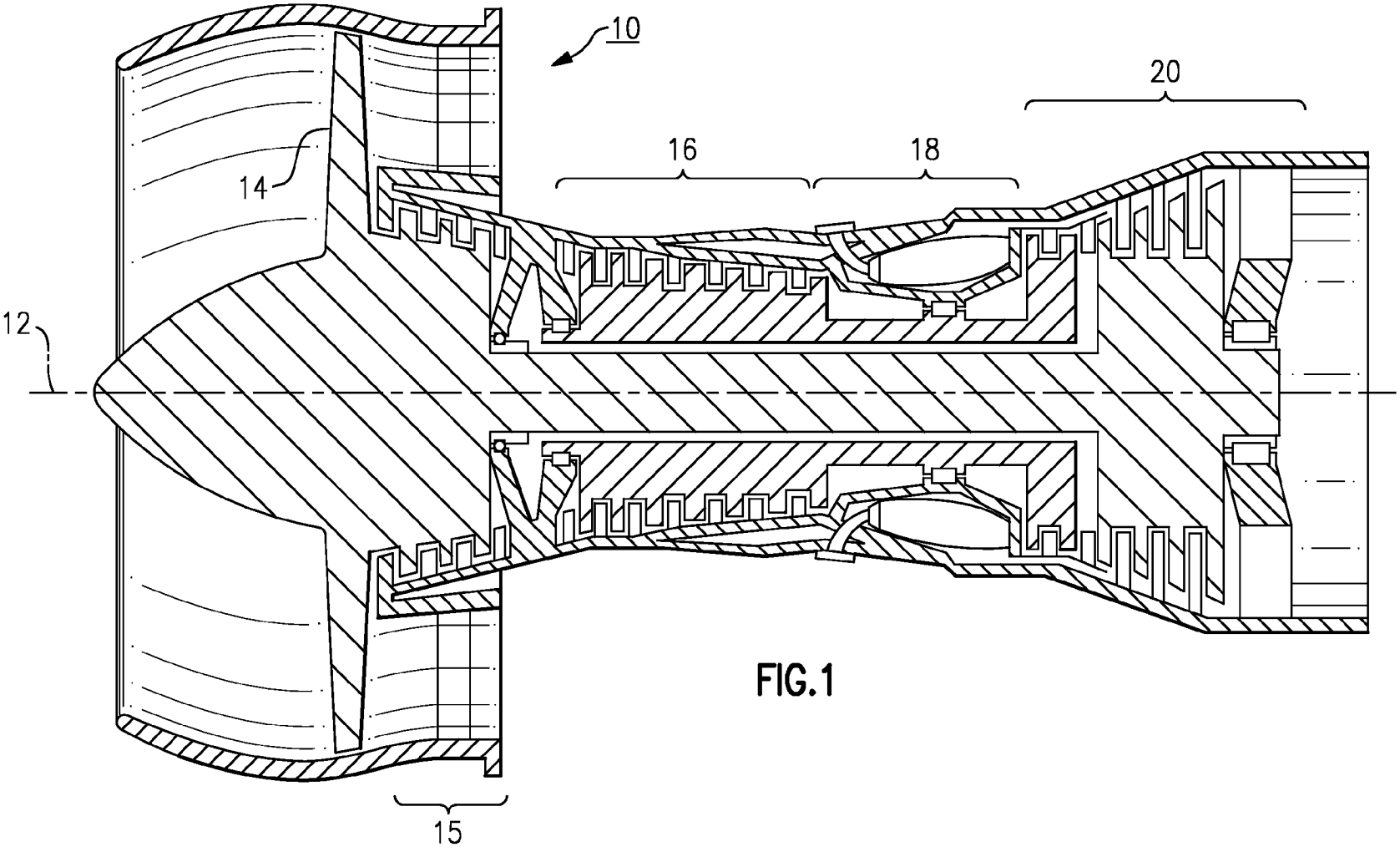
FIG. 1 shows a schematic of the gas turbine engine.

A gas turbine engine 10, such as a turbofan gas turbine engine, circumferentially disposed about an engine centerline, or axial centerline axis 12 is shown in FIG. 1. The engine 10 includes a fan section 14, compressor sections 15 and 16, a combustion section 18 and a turbine 20. As is well known in the art, air compressed in the compressor 15/16 is mixed with fuel and burned in the combustion section 18 and expanded in a turbine section 20. It should be understood that this view is included simply to provide a basic understanding of the sections in a gas turbine engine, and not to limit the invention. This invention extends to all types of turbine engines for all types of applications.

Figure 2:
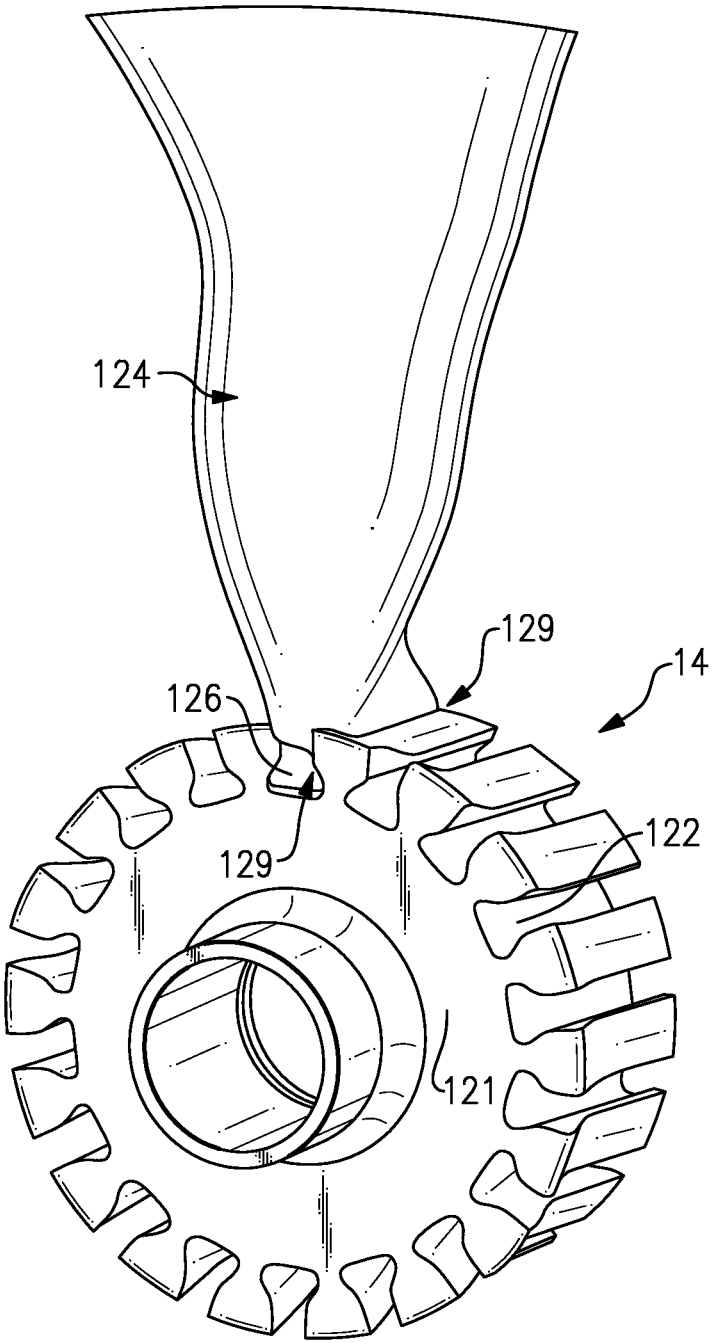
FIG.2 Prior Art
FIG. 2 is a view of a fan rotor and blade.

As shown in FIG. 2, the fan section 14 may include a rotor disk 121 which includes a plurality of disk slots 122. Each disk slot receives a fan blade 124 having a radially outer airfoil and a radially inner dovetail 126. As can be seen, the dovetail is generally triangular in cross-section, and slides within the slots 122.

In one type of fan blade 124, the airfoil and dovetail are formed of composite materials, and are relatively rigid. The rotor disk is also formed of a rigid material. During operation, there are stress concentrations at the axial ends 129 of the dovetails 126 within the disk slots 122. This is undesirable, and can lead to premature wear on the blades 124.

Figure 3:
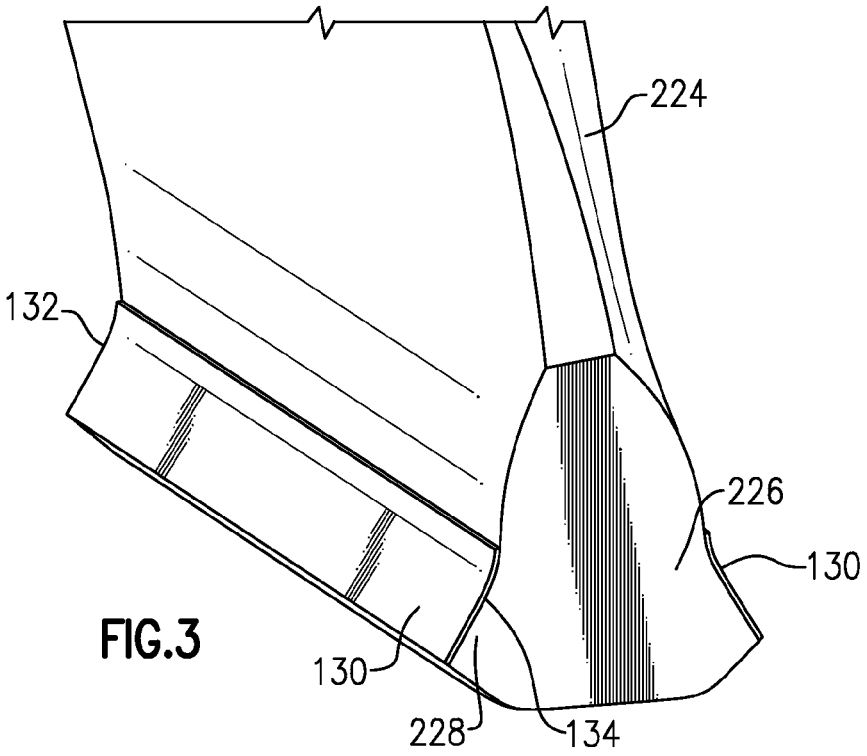
FIG. 3 shows a first embodiment of this invention.

An embodiment of this invention is shown in FIG. 3. As shown, an inventive blade 224 incorporates a dovetail 226 which has a generally triangular cross-section. A body 228 of the dovetail 226 is formed of a relatively rigid composite material. Outer compliant layers 130 are positioned on each circumferential side of the body 228. The layers 130 preferably extend from one axial end 132 to the opposed axial end 134 of the blade 224.

When the blade 224 is received in a disk slot, the compliant layers will compress as they are more compliant than either the underlying body 228 of the dovetail 226, or the material of the disk slot. With the compliant layers compressing, stresses are spread across the entire contact area, and thus the undesirable effect mentioned above will be reduced.

Figure 4:
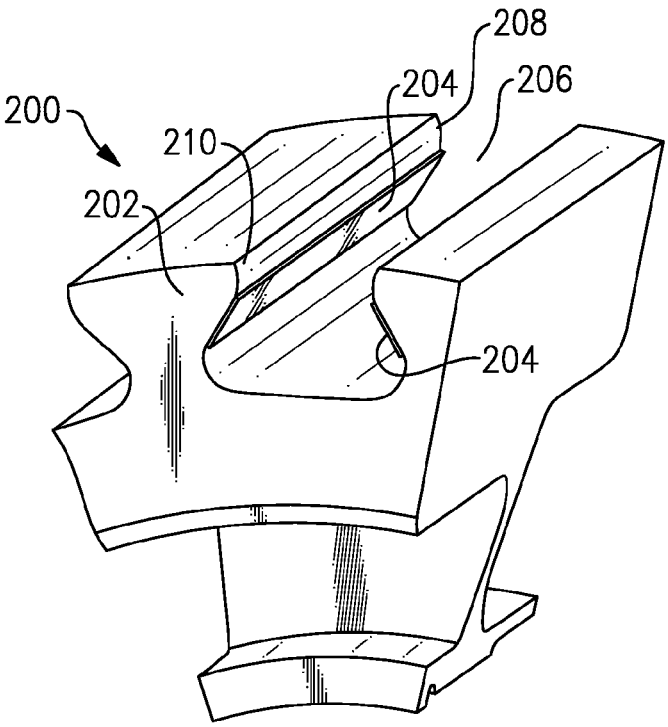
FIG. 4 shows a second embodiment of this invention.

FIG. 4 shows another embodiment 200, wherein the disk 202 has its slots 206 provided with compliant layers 204 extending between the circumferential ends 208 to 210.

The compliant layers may be formed of any number of materials. In one application, a material known as Tuflite®, which is polytetraflouroethylene, Teflon®, fiberglass fiber embedded layers is utilized. However, other materials may be utilized. In general, what is desired is that the compliant layers be more compliant than the underlying blade.

In embodiments, a modulus of elasticity of the underlying material of the blade may be on the order of 1.3 million, while the modulus of elasticity of the material for the compliant layer may be more on the order of 150,000. In embodiments, the modulus of elasticity of the compliant layer may be between 10-25% of the modulus of elasticity of the underlying base material of the blade. The blade and the compliant layer are sized such that they can be received in the disk slot without deformation. However, upon load, there is plastic deformation of the compliant material.

Although embodiment of this invention have been disclosed, a worker of ordinary skill in this art would recognize that certain modifications would come within the scope of this invention. For that reason, the following claims should be studied to determine the true scope and content of this invention.

What is claimed is:

1. A fan blade comprising:

an airfoil, and a dovetail at a radially inner end of said airfoil, said dovetail extending between first and second axial ends, and having outer circumferential faces;

said dovetail is formed of relatively rigid composite material;

compliant material placed on each outer circumferential face of said dovetail, said compliant material being less rigid than said composite material for forming said dovetail;

said compliant material is formed of a layer of material; and said relatively rigid composite material has a first modulus of elasticity, and said compliant material has a second modulus of elasticity, and wherein said second modulus of elasticity is between 10-25% of said first modulus of elasticity.

2. The blade as set forth in claim 1, wherein said layer extends from said first axial end to said second axial end on both of said outer circumferential faces.

3. The blade as set forth in claim 1, wherein said layer is formed of a polytetraflouroethylene fiber and fiberglass fiber material.

4. The blade as set forth in claim 1, wherein said compliant material is sized such that said fan blade can be received in a slot in a disk without deformation.

5. A fan section for a gas turbine engine comprising:

a rotor disk having a plurality of circumferentially spaced disk slots;

blades received within said disk slots, said blades having an airfoil extending radially outwardly of said rotor disk, and a dovetail received within said disk slots, with contact surfaces between said disk slots and said dovetails, said dovetails being formed of a first relatively rigid composite material, and said rotor disk being formed of a second relatively rigid material;

intermediate compliant material at said contact surfaces between said dovetails and said disk slots, said compliant material being less rigid than said first or second rigid materials;

said first relatively rigid composite material has a first modulus of elasticity, and said compliant material has a second modulus of elasticity, and wherein said second modulus of elasticity is between 10-25% of said first modulus of elasticity; and said compliant material is formed of a layer of material at each of said contact surfaces.

6. The fan section as set forth in claim 5, wherein said layer extends from said first axial end to said second axial end on both of said outer circumferential faces.

7. The fan section as set forth in claim 5, wherein said layers are formed of a polytetraflouroethylene fiber and fiberglass fiber material.

8. The fan section as set forth in claim 5, wherein said layers are positioned on opposed circumferential faces of said disk slots.

9. The fan section as set forth in claim 5, wherein said layers are positioned on said outer circumferential faces of said dovetails.

10. The fan section as set forth in claim 5, wherein said compliant material is sized such that said blade can be received in a disk slot without deformation.

11. The fan section as set forth in claim 10, wherein said compliant material undergoes plastic deformation upon load when said rotor disk is mounted in a gas turbine engine.

* * * * *